US006902352B2

(12) United States Patent
Kim

(10) Patent No.: US 6,902,352 B2
(45) Date of Patent: Jun. 7, 2005

(54) SOFT GROUND IMPROVEMENT SYSTEM

(76) Inventor: Yong-Hyun Kim, 150-104 Old Jugong Apt. 1, 2008 Sanbon 2 Dong, Gunpo-City, Kyunggi-Do (KR)

( * ) Notice: Subject to any disclaimer, the term of this patent is extended or adjusted under 35 U.S.C. 154(b) by 0 days.

(21) Appl. No.: 10/791,999

(22) Filed: Mar. 3, 2004

(65) Prior Publication Data

US 2004/0175242 A1 Sep. 9, 2004

(30) Foreign Application Priority Data

Mar. 4, 2003 (KR) ..... 10-2003-0013308

(51) Int. Cl.[7] ..... E02D 5/18
(52) U.S. Cl. ..... 405/269; 405/266
(58) Field of Search ..... 405/269, 268, 405/267, 266, 240, 241, 233

(56) References Cited

U.S. PATENT DOCUMENTS 3,802,203 A * 4/1974 Ichise et al. ..... 405/264
3,969,902 A * 7/1976 Ichise et al. ..... 405/267
4,084,648 A * 4/1978 Yahiro et al. ..... 175/67
4,624,606 A * 11/1986 Nakanishi et al. ..... 405/269
4,659,259 A * 4/1987 Reed et al. ..... 405/263
5,141,366 A * 8/1992 Ishida et al. ..... 405/263
5,234,289 A * 8/1993 Nakanishi et al. ..... 405/303
5,304,016 A * 4/1994 Kunito ..... 405/233

FOREIGN PATENT DOCUMENTS

JP 59038416 A * 3/1984 ..... E02D/3/12
JP 06049834 A * 2/1994 ..... E02D/3/12

* cited by examiner

*Primary Examiner*—Heather Shackleford
*Assistant Examiner*—Lisa M. Saldano
(74) *Attorney, Agent, or Firm*—Jordan and Hamburg LLP

(57) ABSTRACT

An apparatus for improving soft ground, in which cement slurry is vigorously discharged from an injection rod by highly pressurized air, thus allowing hardening agent to evenly infiltrate the soft ground, is disclosed. The apparatus includes an injection rod (20) having an injection pipe (10) into which fluid is introduced, and an outer casing (12) disposed around the injection pipe (10) with an air feeding path (14) therebetween, one or more injection holders (40) coupled to an outer surface of the outer casing (12) to be positioned at different levels and to be inclined downward, and a bit (30) coupled to a lower end of the injection rod (20), and having jet holes **(60, 60*a*), which are inclined downward and in which inclined jet nozzles (70, 70*a*) are inserted, and a cutting water nozzle (74)** provided at its center.

5 Claims, 7 Drawing Sheets

PRIOR ART

PRIOR ART

SOFT GROUND IMPROVEMENT SYSTEM

BACKGROUND OF THE INVENTION

1. Field of the Invention

The present invention relates to an apparatus for improving soft ground, which is used in civil engineering works, and more particularly to an apparatus for improving soft ground, in which composite slurry including cement is introduced in an injection rod inserted in the ground and is vigorously discharged from the injection rod by air under a high pressure to cause a hardening agent to easily and evenly infiltrate the soil, thereby improving the soft ground.

2. Description of the Prior Art

In general, a method of improving soft ground is extensively known in the art, in which a monitor inserted in a bore formed in the ground is rotated and retracted upward while discharging a liquid-phase hardening agent, such as cement milk, into the bore, thereby providing a pile-shaped solid body in the bore of the ground.

According to the above-mentioned conventional method of improving the soft ground, because properties of the ground are uneven, an infiltrating region of the hardening agent does not have a uniform shape, as shown in FIG. 7.

In the conventional method of improving the soft ground, an injection rod 5 is inserted into the ground, and water and air, or cement slurry and air, which are pressurized under a predetermined pressure, are horizontally discharged from nozzles 2 and 3, as shown in FIG. 8. For this reason, when the improved construction is undertaken in the soft layer of the ground, a discharging distance of the water and air, or cement slurry and air cannot be controlled, thereby causing an infiltrating range of the liquid or slurry to be excessively enlarged, or causing the liquid or slurry to rise along the soft layer. In addition to this, excessive slime is generated from the soft layer, higher costs are incurred due to excessive charging of the material. Furthermore, when the improved construction is undertaken in a clay layer, a compressive strength of the resulting solid body is lowered.

In the improved construction shown in FIG. 8, the liquid and slurry are discharged from the nozzles 2 and 3 such that the discharging direction of the liquid and slurry defines the right angle with respect to the direction of the liquid and slurry being introduced into the injection rod 5. Accordingly, since a pressure of the liquid and slurry is lowered at the inflection point, the efficiency of the improved construction is deteriorated.

SUMMARY OF THE INVENTION

Accordingly, the present invention has been made keeping in mind the above problems occurring in the prior art, and an object of the present invention is to provide an apparatus for improving the soft ground, which discharges water and hardening agent from nozzles under a high pressure in a direction which is inclined downward rather than horizontally, so as to finely cut soil of the ground and to excavate a uniform bore in the ground, thereby achieving a solid body having a desired strong uniform shape, regardless of conditions of the soil.

In order to accomplish the above object, the present invention provides an apparatus for improving soft ground, including an injection rod having an injection pipe into which fluid is introduced, and an outer casing disposed around the injection pipe with an air feeding path therebetween, one or more injection holders coupled to an outer surface of the outer casing to be positioned at different levels and to be inclined downward, and a bit coupled to a lower end of the injection rod, and having jet holes, which are inclined downward and in which inclined jet nozzles are inserted, and a cutting water nozzle provided at its center.

The injection holders may be coupled to the injection pipe and the outer casing to be horizontally positioned.

Each of the injection holders may include a tubular connecting holder coupled to the injection pipe through the outer casing, a flange disposed under a lower end of the connecting holder and having a plurality of air guide holes, a nozzle fitted in the flange, a jet guide holder having an upper space in which the nozzle fitted in the flange is received, and a drain hole having a diameter smaller than that of the space and connected to the space, in which a snap ring is partially embedded in an inner surface of the jet guide holder to support an upper end of the flange), with a check rubber ring disposed under the flange in the space, and a support cap interposed between the flange and the check rubber ring to support the check rubber ring, and a protection pipe threadedly coupled to the jet guide holder at its one end and coupled to the outer casing at the other end.

The apparatus may further include a check packing provided under the flange in the space of the jet guide holder.

The nozzle fitted in the flange may include an arched concave surface and an inclined surface at its upper end.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

This invention will be described in further detail by way of example with reference to the accompanying drawings.

Figure 1:
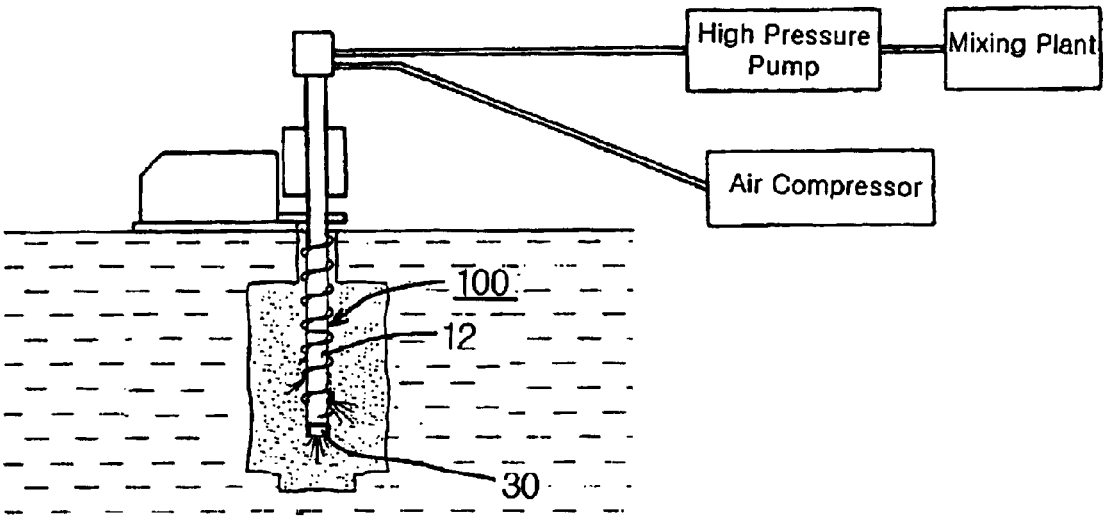
FIG. 1 is a schematic view showing a ground improvement work using an injection rod according to the present invention.
Figure 2:
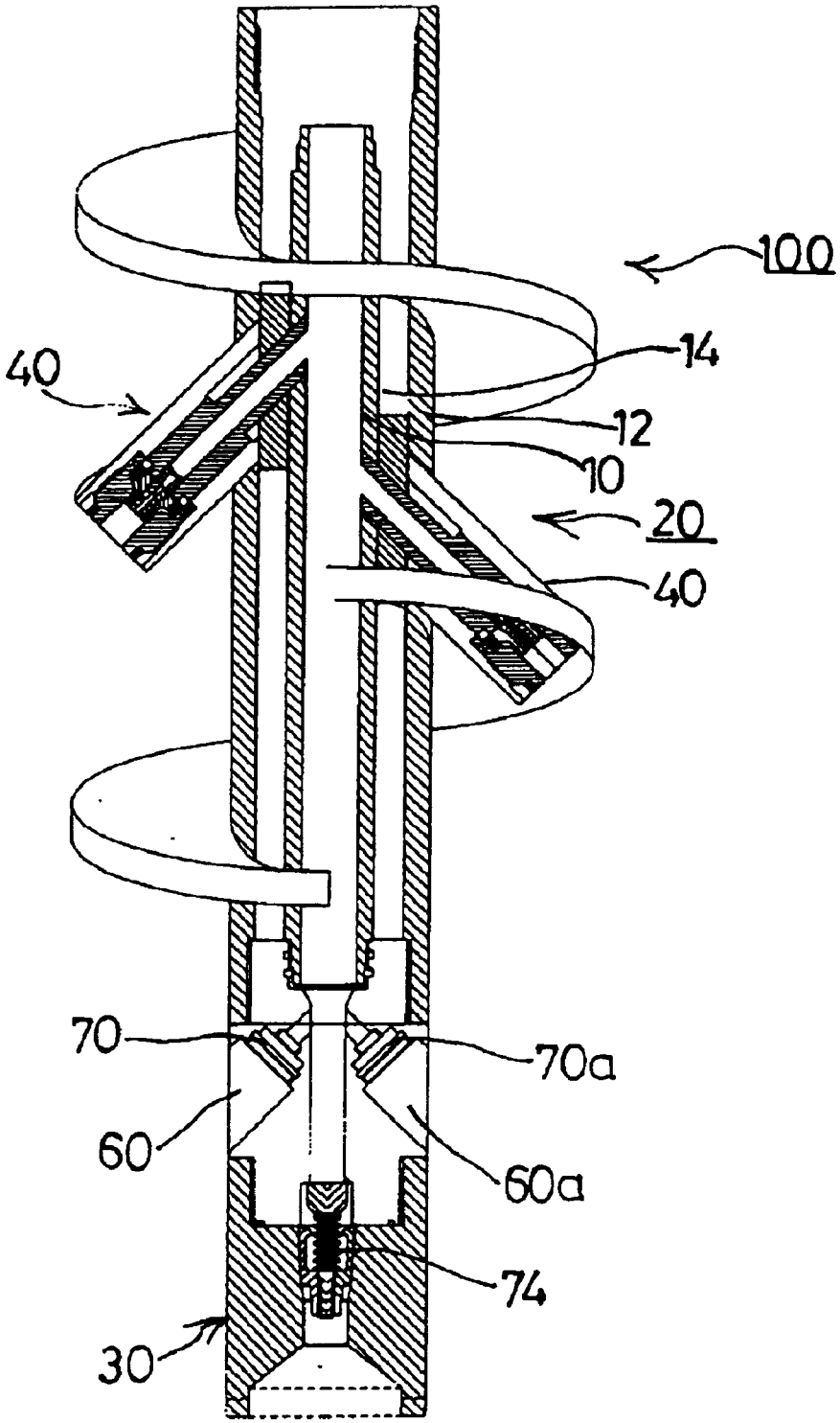
FIG. 2 is a cross-sectional view showing a substantial part of the injection rod of FIG. 1.
Figure 3:
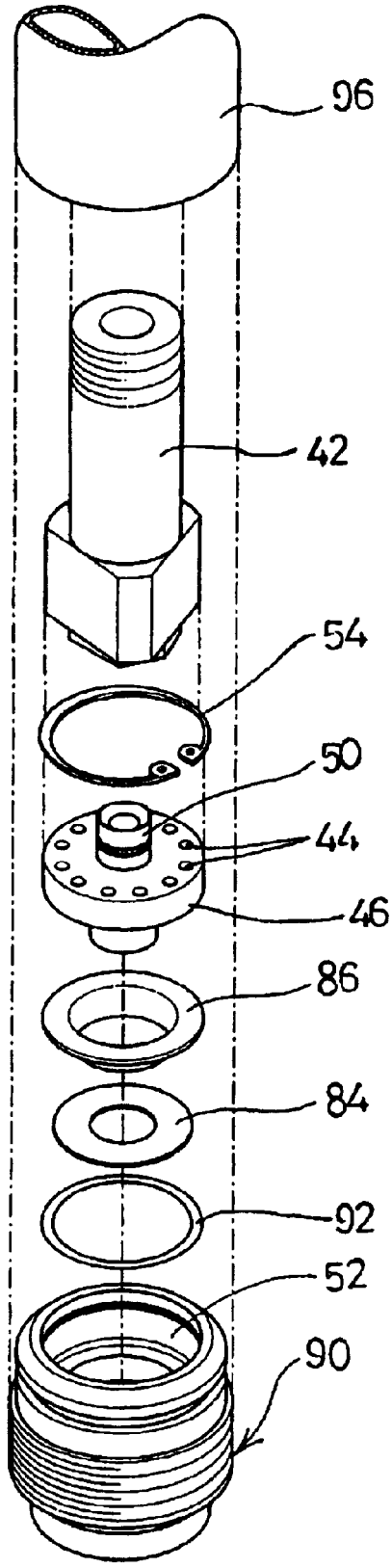
FIG. 3 is an exploded perspective view showing injection holders according to the present invention.
Figure 4:
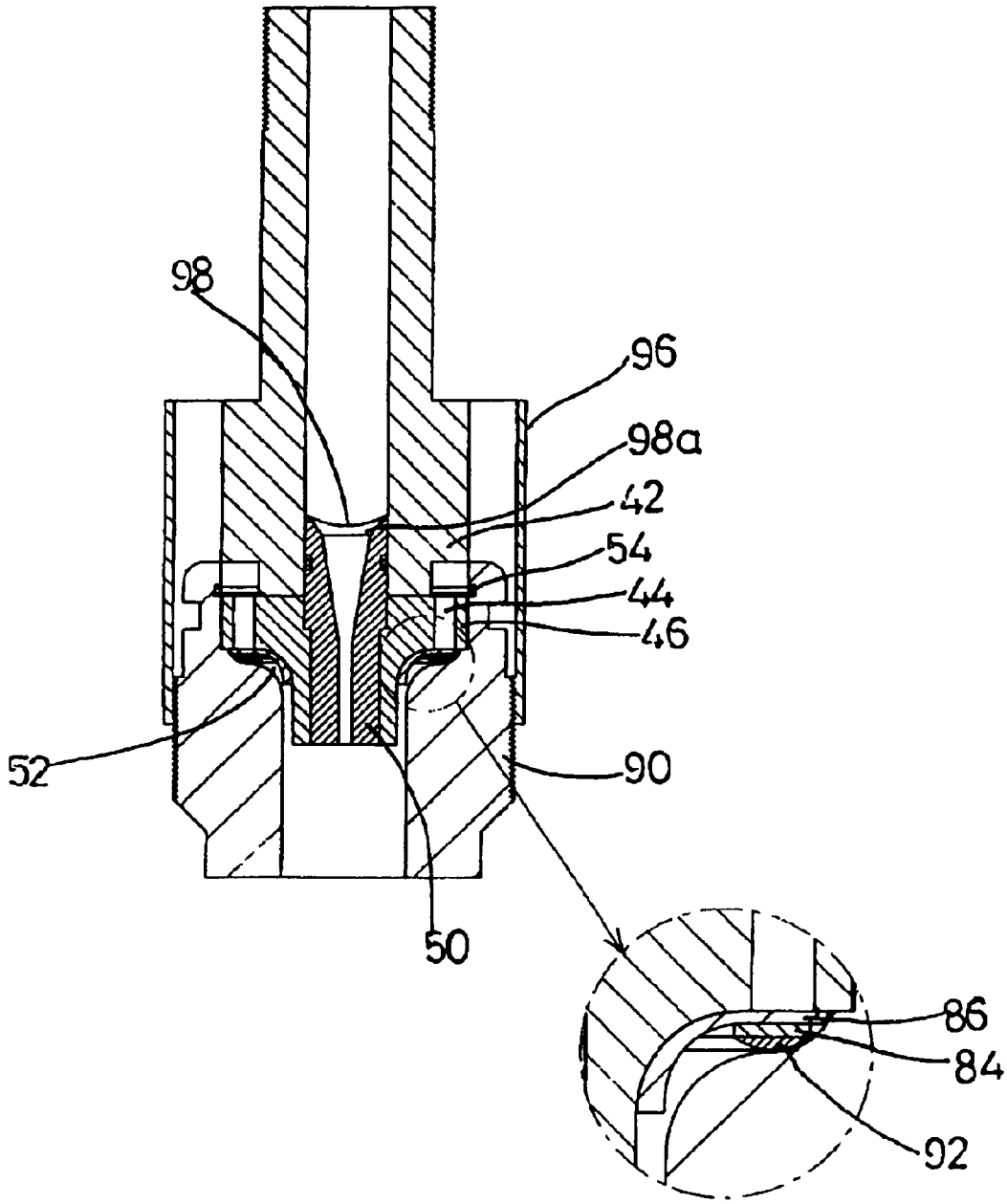
FIG. 4 is a vertical cross-sectional view of the injection holder.
Figure 5:
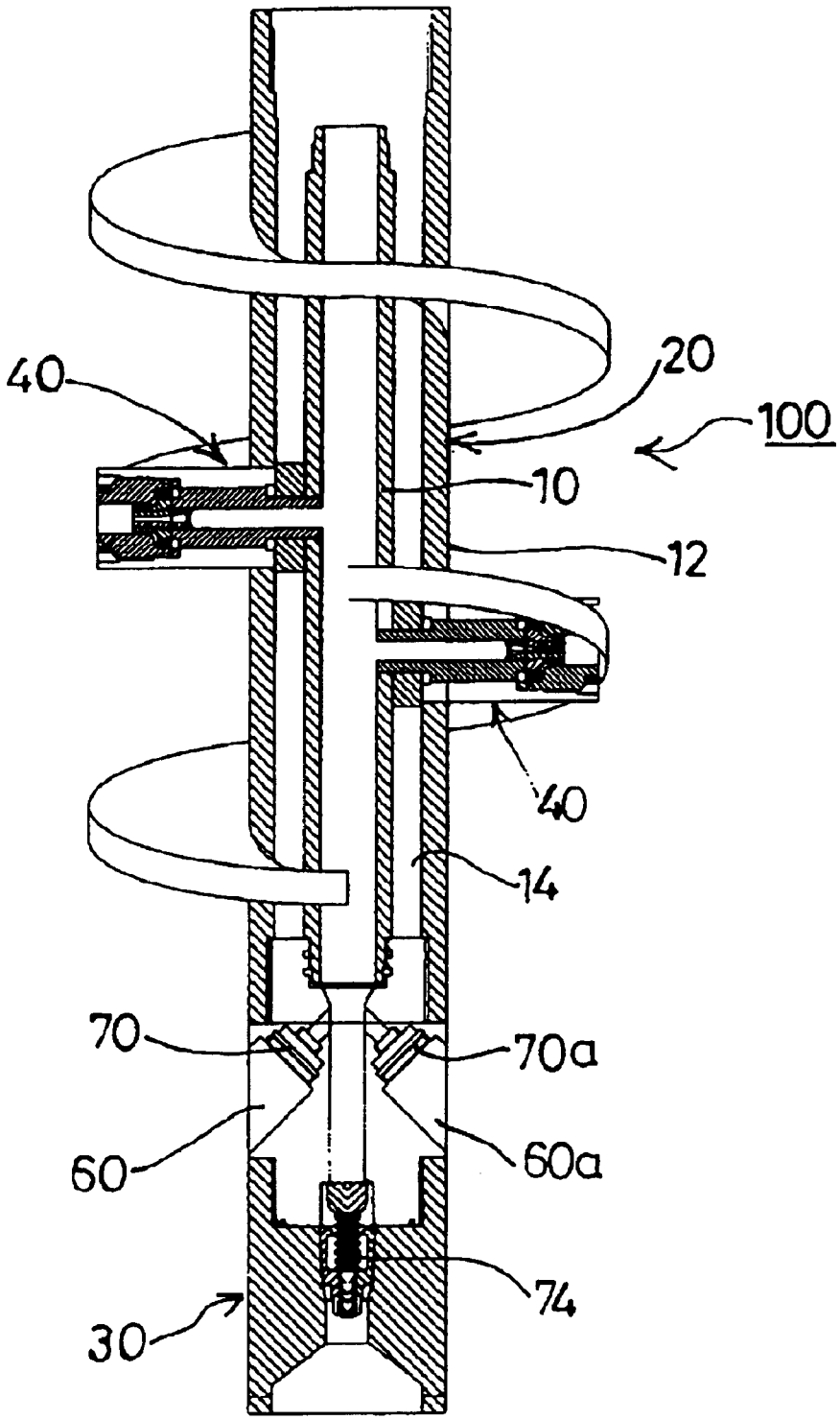
FIG. 5 is a cross-sectional view showing a substantial part of the injection rod according to another embodiment of the present invention, in which injection holders are horizontally mounted on an injection rod.
Figure 6:
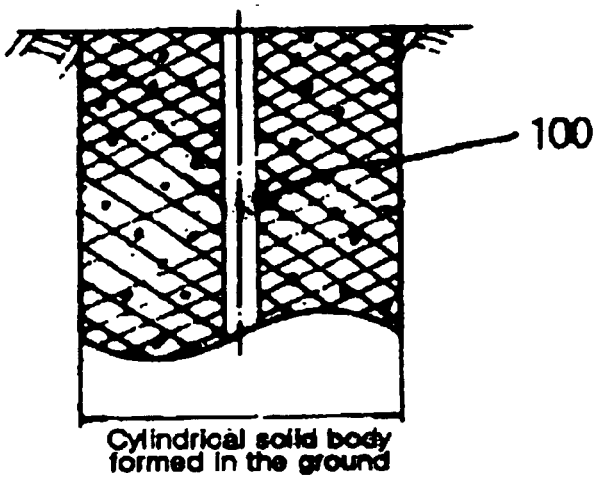
FIG. 6 is a cross-sectional view showing a cylindrical solid body formed in the ground by the apparatus according to the present invention.
Figure 7:
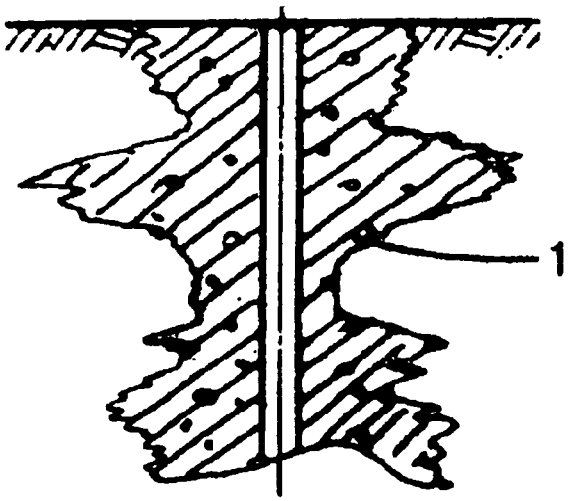
FIG. 7 is a cross-sectional view showing a solid body formed in the ground by a prior art.
Figure 8:
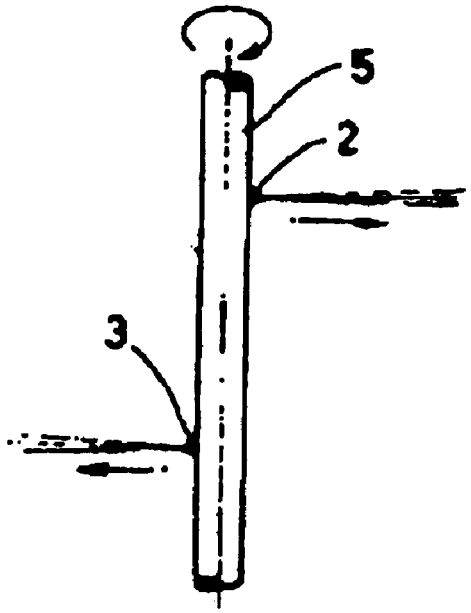
FIG. 8 is a schematic view showing a prior art apparatus for improving soft ground, which horizontally discharges liquid.

FIG. 1 is a schematic view showing a ground improvement work using an injection rod according to the present invention, FIG. 2 is a cross-sectional view showing a substantial part of the injection rod of FIG. 1, FIG. 3 is an exploded perspective view showing injection holders according to the present invention, FIG. 4 is a vertical cross-sectional view of the injection holder, FIG. 5 is a cross-sectional view showing a substantial part of the injection rod according to another embodiment of the present invention, in which injection holders are horizontally mounted on an injection rod, and FIG. 6 is a cross-sectional view showing a cylindrical solid body formed in the ground by the apparatus according to the present invention.

As shown in FIGS. 1 through 6, an apparatus for improving soft ground, according to the present invention comprises an injection rod 20 including an injection pipe 10 into which fluid is introduced, an outer casing 12 disposed around the injection pipe 10 with an air feeding path 14 therebetween, a bit 30 coupled to a lower end of the injection rod 20, and one or more injection holders 40 mounted on an outer surface of the outer casing 30 to be inclined downward.

The one or more injection holders 40 are mounted on predetermined positions of the outer casing 30 of the injection rod 20 such that the one or more injection holders 40 are positioned at different levels and extended outward and downward.

Each of the injection holders 40 includes a tubular connecting holder 42, which passes through the outer casing 12 and is connected to the injection pipe 10, a flange 46 joined to a lower end of the connecting holder 42 and having a plurality of air guide holes 44, and a nozzle 50 fitted in the central hole of the flange 46.

The nozzle 50 is integrally fitted in the flange 46, and is disposed in a space 52 formed in a jet guide holder 90. The jet guide holder 90 is provided with a snap ring 54, which is partially embedded in an inner surface of the jet guide holder 90, so as to prevent the flange 46 from being separated from the jet guide holder 90.

The jet guide holder 90 further includes a drain hole 56 at its lower portion, which has a diameter smaller than that of the space 52 and is continuously connected to the space 52.

The jet guide holder 90 is provided at its outer surface with a threaded region, on which a protection pipe 96 mounted on the outer casing 12 is threadedly coupled.

A check packing 92 is provided under the flange 46 in the space 52 of the jet guide holder 90, so as to allow fluid to flow in a direction but checking the flow in the reverse direction.

Furthermore, a check rubber ring 84 is disposed under the flange 46 in the space 52 of the jet guide holder 90. A support cap 86 is interposed between the flange 46 and the check rubber ring 84 to support the check rubber ring 84. Thus, the fluid is prevented from flowing in the reverse direction even when a discharging action of pressurized air and fluid is stopped. That is, when the discharging action of the pressurized air and fluid is undesirably stopped during the pressurized air and fluid discharging process, the check rubber ring 84 is in close contact with the check packing 92 in the space 52. The support cap 86 in the above state further compresses the check rubber ring 84 on the check packing 92, thus closing the air guide holes 44 of the flange 46. Therefore, even though an unexpected situation, such as the breakdown of a hardening agent shifting pump, is caused, it is possible to prevent soil placed in the drain hole 56 of the jet guide holder 90 from undesirably flowing into the air guide holes 44 of the flange 46.

The nozzle 50, which is fitted in the flange 46, is provided at its upper end with an arched concave surface 98 and an inclined surface 98*a* to allow cement slurry to be smoothly introduced into the nozzle 50, thus preventing clogging and reduction a central hole of the nozzle 50.

The bit 30 is joined to a lower end of the injection rod 20. The bit 30 includes jet holes 60 and 60*a*, which are inclined downward, and in which inclined jet nozzles 70 and 70*a* are inserted. The bit 30 further includes a cutting water nozzle 74 at its center.

In an operation of improving soft ground by the apparatus according to the present invention, a target ground is uniformly excavated by water get discharged from the bit 30 joined to the lower end of the injection rod 20, and composite slurry (mixture of cement, reinforcing agent and quick setting agent) is injected into the excavated bore of the ground to form a cylindrical solid body, as shown in FIG. 1. During the ground improvement operation, the apparatus is coupled to a mixing plant and an air compressor, with a high pressure pump provided on a feed line between the apparatus and the mixing plant to pump the composite slurry from the mixing plant to the apparatus.

More specifically, the connecting holder 42 is first connected to the injection pipe 10 of the injection rod 20 to be inclined downward. Subsequently, the flanges 46 and the nozzle 50 are integrally inserted into the space 52 of the jet guide holder 90, and the flange 46 is supported by the snap rings 54. When the jet guide holder 90 is threadedly coupled to an end of the protection pipe 96 with the other end being welded to the outer casing 12, the nozzle 50 is inserted into the lower end of the connecting holder 42. At this point, the injection holder 40 is assembled in the airtight condition by the sealing performance of the check packing 92.

In such a manner, one or more injection holders 40 are mounted on the injection rod 20 to be positioned at different levels and to be inclined downward.

Highly pressurized water is supplied into the injection pipe 10 of the injection rod 20, while pressurized air is supplied into the air-feeding path 14.

The pressurized water and air are introduced into the injection holder 40. At this point, the pressurized air is introduced into a gap between the protection pipe 96 and the connecting holder 42, and the pressurized water is introduced into the connecting holder 42 and then discharged through the nozzle 50.

While the pressurized water is discharged through the nozzle 50, the pressurized air is introduced into the space 52 of the jet guide holder 90 through the air guide holes 44. Accordingly, since the pressurized air is added to the pressurized water, which is discharged through the nozzle 50, the pressurized water is more vigorously discharged through the drain hole 56 with the aid of the pressurized air.

The pressurized water, which is introduced in the injection pipe 10, is also discharged to be inclined downward through the inclined jet nozzles 70 and 70*a* fitted in the jet holes 60 and 60*a*, and vertically discharged through the cutting water nozzle 74 mounted on the center of the bit 30.

When the pressurized water is discharged through the nozzles under a pressure of 200 kg/cm$^2$, the discharging distance of the pressurized water is 1.5 m in the case of the present invention while the discharging distance of the pressurized water is 1 m in the case of a prior art.

When the excavating operation is completed, composite slurry and air are discharged through the nozzle in the same manner as that of the pressurized water and air. At this time, the composite slurry is supplied into the injection pipe 10 of the injection rod 20 while the pressurized air is supplied into the air-feeding path 14. Thereafter, the composite slurry and the pressurized air are discharged to the outside through the same paths, thereby forming a solid body.

The finished solid body is shaped into a stable structure having a uniform external diameter, as shown in FIG. 6.

According to the present invention, since the top end of the nozzle 50 is provided with the arched concave surface 98 and the inclined surface 98*a*, composite slurry including cement, which is under the influence of the high pressure, is gently guided to the end of the nozzle 50 by the arched surface 98, and quickly introduced into the nozzle 50 by the inclined surface 98*a*. Therefore, it is possible to prevent clogging of the nozzle and to achieve a desirable discharging state of the composite slurry.

In addition, since the check packing 92 is provided between the flange 46 and the jet guide holder 90, to allow outflow of fluids while preventing back flow of fluids, it is possible to prevent undesirable contaminants such as soil and cement from flowing into the apparatus.

FIG. 5 is a cross-sectional view showing an apparatus according to another embodiment of the present invention. In this embodiment, injection holders 40 are horizontally mounted on the injection rod 20. Since the apparatus according to this embodiment has the same functions as those of the previous embodiment, the detailed description of the apparatus is omitted.

As described above, the present invention provides an apparatus for improving soft ground, which is capable of providing a uniform solid body regardless of soil conditions of the target ground by evenly excavating a bore and discharging hardening agent by control of nozzles. According to the present invention, since soil is crushed into minute particles in the excavating operation, injection material efficiently infiltrates the soil. In addition, since composite slurry is solidified as soon as it is discharged from the nozzles, it is possible to prevent undesirable material from flowing out of the ground surface. Furthermore, the apparatus according to the present invention has additional advantages in that working property is excellent, the improving efficiency for the soft ground is enhanced, and a construction period is shortened.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An apparatus for improving soft ground, comprising:

an injection rod including an injection pipe into which fluid is introduced, and an outer casing disposed around the injection pipe with an air feeding path therebetween;

one or more injection holders coupled to an outer surface of the outer casing positioned at different levels;

wherein each of the injection holders includes:

a tubular connecting holder coupled to the injection pipe through the outer casing;

a flange disposed under a lower end of the connecting holder and having a plurality of air guide holes;

a nozzle fitted in the flange;

a jet guide holder having an upper space in which the nozzle fitted in the flange is received, and a drain hole having a diameter smaller than that of the space and connected to the upper space, in which a snap ring is partially embedded in an inner surface of the jet guide holder to support an upper end of the flange, with a check rubber ring disposed under the flange in the upper space, and a support cap interposed between the flange and the check rubber ring to support the check rubber ring; and a protection pipe threadedly coupled to the jet guide holder at one end of the protection pipe and coupled to the outer casing at another end; and a bit, coupled to a lower end of the injection rod, and defining jet holes, which are inclined downward and have inclined jet nozzles inserted therein, and a cutting water nozzle, provided at a center of the bit.

2. The apparatus as set forth in claim 1, wherein the one or more injection holders are coupled to the injection pipe and the outer casing and are horizontally positioned.

3. The apparatus as set forth in claim 1, further comprising a check packing provided under the flange in an upper space of the jet guide holder.

4. The apparatus as set forth in claim 1, wherein the nozzle fitted in the flange includes an arched concave surface and an inclined surface at an upper end thereof.

5. The apparatus as set forth in claim 1, wherein the one or more injection holders are coupled to the injection pipe and the outer casing and inclined downward.

* * * * *